United States Patent [19]

Deisinger

[11] Patent Number: 5,063,374

[45] Date of Patent: Nov. 5, 1991

[54] SIMULTANEOUS SIGNAL DEVICES TESTING IN RESPONSE TO PERIODIC FUNCTION OF AN OPERATING DEVICE IN A SYSTEM

[75] Inventor: John J. Deisinger, Wauwatosa, Wis.

[73] Assignee: A. O. Smith Corp., Milwaukee, Wis.

[21] Appl. No.: 637,925

[22] Filed: Jan. 8, 1991

Related U.S. Application Data

[63] Continuation of Ser. No. 400,466, Aug. 29, 1989, abandoned.

[51] Int. Cl.[5] ..... G08B 21/00

[52] U.S. Cl. ..... 340/642; 315/129; 340/516

[58] Field of Search ..... 340/642, 515, 516, 458; 307/10.8; 315/129, 130, 133

[56] References Cited

U.S. PATENT DOCUMENTS

| | | | |
|---|---|---|---|
| 3,803,544 | 4/1974 | Klein et al. | 340/515 |
| 4,150,369 | 4/1979 | Gaspari et al. | 340/516 |
| 4,222,031 | 9/1980 | Okamoto et al. | 340/459 |
| 4,447,801 | 5/1984 | Masuda | 340/516 |
| 4,451,822 | 5/1984 | Verse et al. | 340/642 |
| 4,644,266 | 2/1987 | Reuter | 324/73 |
| 4,745,339 | 5/1988 | Izawa et al. | 315/130 |

FOREIGN PATENT DOCUMENTS

| | | | |
|---|---|---|---|
| 2917964 | 11/1979 | Fed. Rep. of Germany | 340/515 |
| 2082360 | 3/1982 | United Kingdom . | |
| 2170932A | 2/1985 | United Kingdom . | |

*Primary Examiner*—Donnie L. Crosland
*Assistant Examiner*—Jill Jackson
*Attorney, Agent, or Firm*—Andrus, Sceales, Starke & Sawall

[57] ABSTRACT

A test circuit for testing all lamps in a system monitor for a hot water heater. The comparator includes a amplifier having a reference input connected to a reference voltage and a second control input connected to power through a plurality of different circuit elements in a voltage coupling network. A timer is connected in the circuit to the control input to provide a timed drive signal to a power switch unit connected to the comparator amplifier for energizing all of the lamps. The timer is a simple resistor-capacitor network with the comparator connected to the signal control input. The signal branch circuit includes components selectively inserted to produce a test signal to the timer and comparator amplifier. A thermostat monitor is connected by a diode to the comparator amplifier and a demand for hot water creates a turn-on signal to the comparator for the period of the timer to energize all lamps for a short period at the initiation of the demand. A diode selectively connects the power line to the comparator amplifier and turns on all the lamps for the period of the timer. A direct manual control is connected to the power switch for manufal testing of the lamps.

8 Claims, 1 Drawing Sheet

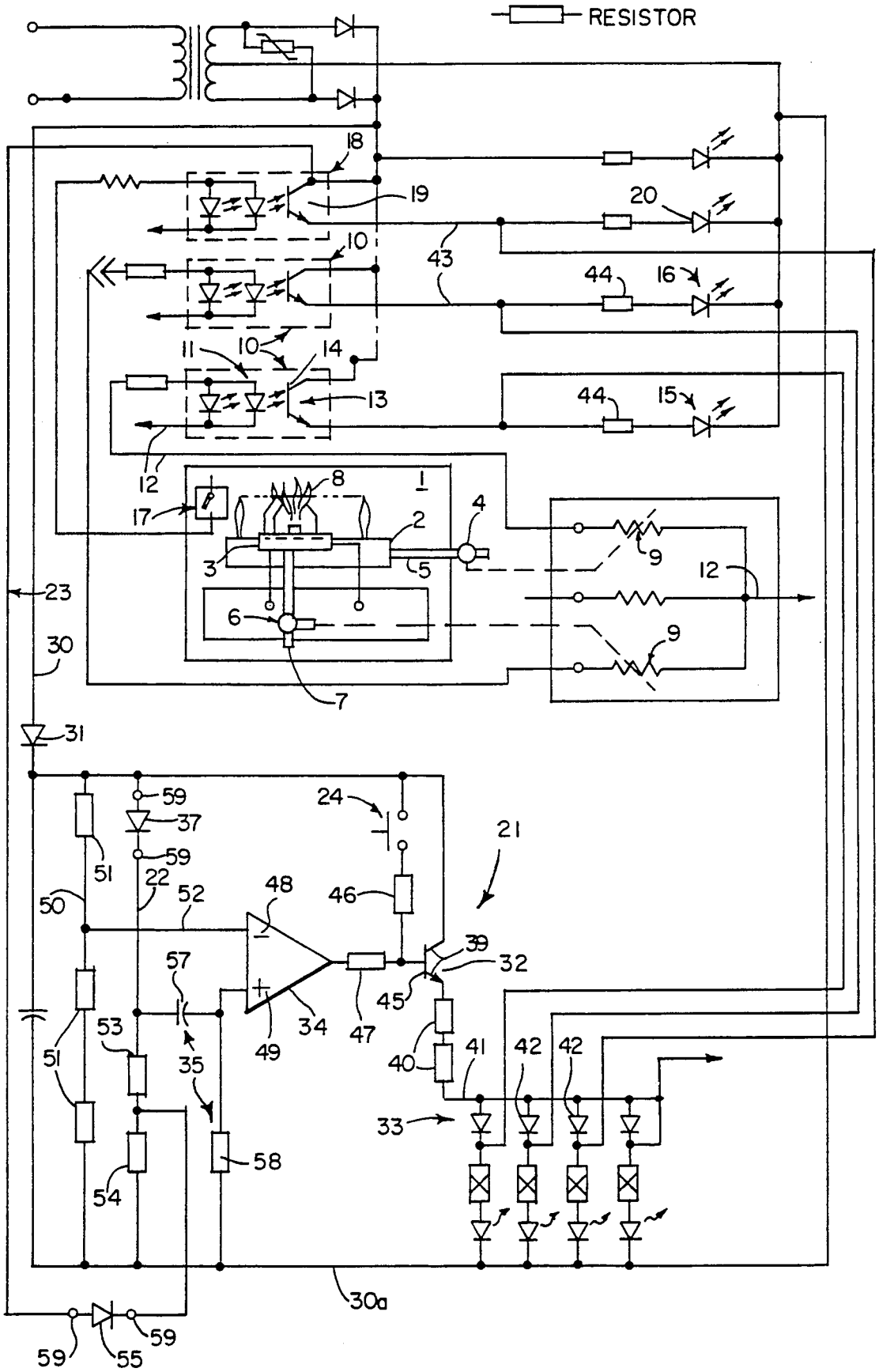
RESISTOR
18
19
20
10
43
44
16
11
14
13
15
12
8
1
17
2
4
3
5
9
6
7
23
30
31
59
37
24
21
51
22
52
48
46
50
39
32
57
45
53
34
47
49
35
40
41
42
33
58
54
30a
55

SIMULTANEOUS SIGNAL DEVICES TESTING IN RESPONSE TO PERIODIC FUNCTION OF AN OPERATING DEVICE IN A SYSTEM

This application is a continuation of Ser. No. 07/400,466, filed Aug. 29, 1989, now abandoned.

BACKGROUND OF THE PRESENT INVENTION

This invention relates to a signal testing system for multiple element monitoring apparatus and systems.

Various machines, systems and devices are connected to monitoring systems to provide automatic indication of the status and functioning of the monitored or operating system. The monitoring apparatus may include a suitable alarm or signal device or devices for individual components and functions of the operating systems to provide a desired visual or audible indication of the status of the components and functions to the signal devices and in particular indicate any malfunction or deviation from a selected system operation. For example, the co-pending application of John J. Deisinger et al, filed Oct. 16, 1987 and Ser. No. 07/109,707 and entitled "Water Heater Diagnostic Apparatus" discloses a unique monitor particularly applied to a hot water heating unit. The above application discloses a unique diagnostic system monitoring the various components and functions of the hot water heating control with a plurality of signaling devices shown as LED lamps for displaying the status of certain components as well as for displaying a malfunction of a component or some function of the system. The operating or service personnel can review the display panel and thus detect the status of the system as well as note any malfunction or fault which requires attention and possible service. With the use of the lamps, an accurate display is generated only if all lamps are functioning properly. Thus, if any lamp is burned out, the reliability of the display is correspondingly reduced.

Various systems have been suggested for monitoring of the display lamps. For example, conventionally a push button switch unit is provided such as disclosed in the Deisinger et al application to illuminate the lamps and monitor or detect, the state thereof. U.S. Pat. No. 4,447,801 which issued May 8, 1984 and U.S. Pat. No. 4,451,822 which issued May 29, 1984 each disclose special devices for testing the state of the plurality of display lamps in a monitoring device. In both instances, the system provides a complex display monitoring system to sequentially check each lamp unit. U.S. Pat. No. 4,447,801 discloses a system wherein all lamps are turned on when a main switch is turned on and then the lamps are individually tested. U.S. Pat. No. 4,451,822 suggests that a system which turns on all lamps at once has certain disadvantages and discloses a system to only sequentially check the individual lamps.

There is a need for a simple test circuit permitting selective checking of the lamps under different conditions such as on power up but in addition under other operating conditions such as a demand for a water heating cycle.

SUMMARY OF THE PRESENT INVENTION

The present invention is directed to an improved test circuit for testing the operating state of all or selected indicators in response to a selected demand or demands created within the operating system and particularly such demands which occur frequently and periodically.

Generally, in accordance with the teaching of the present invention, a signal comparator is connected to the power supply of the monitoring system with a timing system or device connected to actuate all the signal devices, simultaneously or in a predetermined manner, in response to a control input created as a result of the demand signal within the operating system. As applied to a hot water heater control including a thermostat demand for hot water, the comparator is advantageously activated each time the thermostat demands a heating cycle. The signal to the comparator drives the timing device to simultaneously energize all signal devices for a short time period at the initiation of the demand, thereby providing a signal to the operating personnel of the operative status of all signal devices.

More particularly in a preferred construction of the present invention, the comparator provides a convenient system for providing multiple indicator monitoring including the signal device test systems such as heretofore used as well as a unique demand response system. The comparator is connected into circuit with a reference input connected to a reference level branch circuit. The opposite side or second control input of the comparator is connected to the power supply through a plurality of different circuit elements in a voltage coupling network providing for selective interconnection of various signals into the control input. A timing unit is coupled into the circuit through the control input to provide a timed drive signal to a power switch unit connected to supply power to all of the signal devices. A direct manual control can be connected to the power switch for manual testing of the signal devices.

More particularly in an embodiment of the invention as applied to the monitoring system disclosed in the applicant's previously identified co-pending application, the comparator is connected to an unfiltered low voltage DC supply from the main monitoring circuit. A voltage dividing network is connected across the unfiltered DC supply to provide a reference signal to the reference branch circuit to a solid state amplifier comparator. The reference voltage drives the comparator on. The control input of the comparator is connected to the signaling branch circuit connected to the unfiltered DC supply. A timing device is connected to the control input of the comparator and to the signal branch circuit. The timing device is preferably a simple resistor-capacitor network with the capacitor connecting the signal input to the signal branch circuit. The signal branch circuit includes components selectively inserted to produce a test signal to the timing device. A pair of voltage dividing resistors are connected in series between the capacitor and the return or common side of the DC supply to provide a first signal input of the control branch circuit. The voltage dividing resistors include a zero ohm resistor connected to the timing capacitor. The demand control signal input line from the monitor is coupled to the connection of the voltage dividing resistor including the zero resistance resistor. The circuit is adapted to various modes of operation including an automatic test in response to turn-on of power to the unit or in response to a demand signal created in the operating system and in the monitor by selected operative removal or addition of the circuit elements in the signal branch circuit. In a power test mode, a diode connects the logic power supply to the timing capacitor. In the demand signal mode, the power-on diode is removed from the circuit, and a diode connects the signal from the thermostat circuit directly to the capacitor through the zero ohm resistor. In both of the above modes, the capacitor transmits the signal directly to the control input to drive the comparator on and thereby provide a turn-on signal to the signal driver. The signal driver conducts and provides timed turn-on of all lamps in response to power up. The manual control can be provided by direct connection of a power turn-on switch connecting power directly to the test driver, and preferably removal of the power-on diode and the demand diode. The manual switch directly applies power to the power driver and effectively remove the comparator.

The present invention provides a simple, reliable and effective means for testing of the lamps at the most critical times in the system operation in providing for automatic turn on and testing during the normal operating cycles as well as during the initial set up and turn on of the system.

BRIEF DESCRIPTION OF THE DRAWING

The drawing furnished herewith illustrates the best mode presently contemplated for the invention and are described hereinafter.

The drawing is a schematic illustration of a test system applied to a hot water heater monitor system.

DESCRIPTION OF THE ILLUSTRATED EMBODIMENT

Referring to the drawing, the present invention is shown applied to a hot water heater 1 such as more fully disclosed in the previously identified co-pending application. The water heater is a gas fired unit having a main burner 2 and a pilot unit 3 for establishing controlling ignition of the main burner.

A main burner valve 4 is connected in a main gas line 5 to control flow of gas to the burner for heating of the water. The pilot unit 3 includes a control pilot valve 6 in the pilot gas line 7 for controlling flow of gas to a pilot unit 3 for initiating the main burner upon demand. To initiate heating of the water, a time sequence is established wherein the pilot valve 6 is actuated to supply gas to the pilot unit 3 with automatic spark ignition to initiate a pilot flame for igniting the main burner 2. With the pilot unit 3 operative and establishing a pilot flame 8, the main burner 2 ignites to heat the water such time as the thermostat or other control indicates that the water has been heated to the desired level, at which time the burner valve 4 close and shuts down the burner system. As more fully disclosed in applicant's co-pending application, the status of the pilot valve 6 and the main burner valve 4 as well as various other functions and components may be monitored on a continuous basis with suitable indication of the component and function status of the components. The valve units 4 and 6 are solenoid valves having an electrically actuated solenoid coil 9 for opening the respective valve and gas line. The monitoring system includes similar units 10 for monitoring the status of the respective valves. Referring to the main burner valve 4, the sensor is shown as an optical isolating transistor unit having an input lamp 11 such as an LED connected via leads 12 to the coil 11 of burner valve 4. The electro-optical sensor is shown including a transistor 13 having a base 14 aligned with the LED lamp 11. The LED unit is connected in parallel with the solenoid coil 9 such that the lamp is energized simultaneously therewith. The light of the lamp 11 activates the transistor 13 to establish a current flow to turn-on a burner status lamp 15 of the monitoring circuit. The pilot unit 3 is similarly monitored as diagrammatically illustrated to turn-on a lamp 16. In addition, a thermostat switch unit 17 is coupled to the control to initiate a heating cycle. The switch unit 17 is coupled to the monitor circuit through an optoisolator switch circuit 18 including a transistor 19 coupled to energize a demand lamp 20. The isolated coupling switch units provide an improved circuit response with a high level of reliability.

The present invention is particularly directed to a test circuit 21 for testing the working state of all, or a selected group of lamps. The monitoring system is preferably constructed as more fully disclosed in the above co-pending application. Such detail does not effect or change the description of the illustrated test circuit and no further description is given herein other than is necessary to clearly and fully describe the present invention.

The present invention is particularly directed to the lamp test circuit 21 including response for periodically testing the operability or the state of the lamps 15, 16 and 20, as well as others in the monitor shown in the co-pending application to insure that the lamps are not burned out and will respond to the turn-on signals from the monitoring circuit. In the illustrated embodiment of the invention, alternate response units are provided through a multiple part control branch circuit 22. A first mode provides for turn-on of all of the lamps 15, 16 and 20 to be tested in response to the turn-on of power. In an alternate mode, the lamps are simultaneously turned on as a result of an input signal coupled to a functioning control shown as the thermostat monitoring circuit and particularly the thermostat opto-isolator 18. In this mode, whenever the thermostat closes to demand a heating cycle, the opto-isolator 18 is energized to turn-on the appropriate indicating lamp 20 associated with the heat demand. Simultaneously, a signal is transmitted via a lead 23 to the test circuit 21 to provide for a timed energization of all lamps 15, 16 and 20. In addition, as more fully discussed hereinafter, a manual test switch 24 is provided permitting the manual actuation of the test circuit 21 to simultaneously turn off all lamps.

Generally, the illustrated embodiment of the test circuit is connected to the unfiltered DC power supply for the monitoring circuit.

Referring to the test circuit 21, power supply lines 30 and **30*a* are coupled to the monitor power circuit and provide a suitable drive power supply for simultaneously driving all of the selected lamps 15, 16 and 20. An isolating diode 31 is connected between the positive power line 30 and the test circuit 21. A power driver 32 shown as an NPN transistor connects the power supply to the parallel lamps 15, 16 and 20, and when the driver 32 is turned on, establishes simultaneous energization of all lamps through a diode-isolated connecting circuit 33, as hereinafter described. The power driver 32 is controlled for various possible modes of testing. In the illustrated embodiment, the manual test switch connects the power driver directly to the power supply lines 30 and 30*a* for manually testing of all lamps 15, 16 and 20 at any time. In addition, a comparator unit 34 is connected through a timing circuit 35 to the control branch circuit 22 to respond to operating system functions. In the illustrated embodiment of the invention, the test circuit 21 selectively permits response to the initial turn-on of power via a coupling diode 37 (shown in phantom) or to a demand function of the operating system, shown as the thermostat switch 17 demanding a heat cycle, via the signal line 23 from the thermostat opto-isolator circuit 18**.

In the illustrated embodiment of the invention, the power driven transistor 32 has its collector-to-emitter circuit 39 connected in series to the output side of the isolating diode 31. The emitter is connected in series with a pair of dropping resistors 40 to a common drive line 41 connected via circuit 33 to the lamps selected to be tested. The isolating diode circuit 33 includes individual isolating diodes 42 similarly connecting the common drive line 41 to each of the light emitting diodes 15, 16 and 20 in common with the drive lines 43 from the main monitoring circuit. Whenever the transistor 32 is turned on, power is simultaneously supplied through each of the isolating diodes 42 in series with the resistor 44 of the monitor circuit to energize and turn-on all connected lamps and providing an indication that the test is established. If any selected lamp 15, 16 or 20 is not on, the corresponding circuit needs immediate attention.

The test turn-on signal is applied to the base 45 of the transistor 32 either by the manual switch 24 or the output of the comparator 34.

The manual lamp test switch 24 is diagrammatically shown as a simple push button switch connected in series with a series resistor 46 between the unfiltered power supply line 30 and the base 45 of the transistor 32. Closing of the switch directly connects power through the power diode 37 to the base, driving the transistor 32 on and illuminating all of the LEDs 15, 16 and 20 during the period that the lamp test switch is held closed.

Alternatively, power is derived selectively from the comparator 34 through a coupling resistor 47 in response to system conditions as more fully developed hereinafter.

More particularly in the illustrated embodiment of the invention, the comparator 34 is shown as a well known comparator amplifier such as one quarter of an LM 324 solid state chip. The comparator 34 includes a negative or turn-off input or terminal 48 and a positive or turn-on input or terminal 49. A reference branch circuit 50 is connected to the power supply and includes a plurality of resistors 51 defining a voltage dividing network. The input 48 of the comparator is connected by a lead 52 directly to an appropriate node within the voltage dividing network to drive the comparator 34 off.

The signal control branch 22 includes the diode 37 or the thermostat line 23 connected operatively in circuit. Diode 37 is connected to the output side of the isolating diode 31 and to the comparator and a pair of series-connected resistors 53 and 54 interconnect to the common return side of the unfiltered DC supply. The two resistors 53 and 54 includes a zero ohm resistor 53 connected to the diode 37 and comparator 34 and a high ohmage resistor 54 connected to the return line. In a practical system, the second resistor 54 has a value of 10 megaohms. The thermostat line 23 is selectively connected in circuit via a removable diode 55.

Timing circuit 35 is interconnected between the signal branch circuit 22, particularly the common connection of the diode 37 and the zero ohm resistor 53, and the positive turn-on input 49 of the comparator 34. In the illustrated circuit, the timing circuit 35 includes a capacitor 57 connected between the branch circuit 22 and the turn-on input 49 of comparator 34 in combination with a resistor 58 connected between the input and the return or common line supply.

With the various components connected as shown, the signal at the reference input 48 holds the comparator off. By selective insertion of either of the diode 37 or the diode 55, the circuit will provide an automated response. In the illustrated embodiment of the invention, the diodes 37 and 55 are shown diagrammatically connected in circuit through suitable plug-in terminals 59 to insert the elements in a selective manner to provide the following functions.

With the diode 55 connected in circuit, the capacitor 57 is coupled to the unfiltered voltage supply via the diode 55 and the opto-isolator circuit 18. In this mode, whenever the thermostat demands a heating cycle, power is supplied to the capacitor 57 through the zero ohm resistor 53 providing power to the capacitor 51 of timing network 35. The signal voltage, corresponding substantially to the D.C. supply voltage, appears at input 49 and the comparator 43 is driven on. The comparator conducts and in turn drives the driver or power transistor 32, establishing simultaneous power to each of the LED lamps 15, 16 and 20. The capacitor 51 charges and reduces the signal level at the input 49. The comparator 34 turns-off when the signal drops below the signal at input 48. When the thermostat opto-isolator 18 turns off, the signal at line 38 is removed and the capacitor 51 discharges through resistors 53 and 54.

In an alternate mode, the diode 55 is removed and the diode 37 is plugged into the control branch 22. The system will now operate in response to power up, that is, when power is supplied to the monitor and simultaneously to the power supply lines 30 and **30*a* and thereby the test circuit 21. When power is supplied to the unit, the capacitor timing circuit is again connected for appropriate charging of the capacitor 51 and supply of a turn-on voltage signal to the comparator 34. Timed energization of the comparator 34** and the lamps is established with turn-on of system power.

Both diodes 37 and 55 are preferably removed for manual testing or suitable switch means provided to disable the comparator 34 and insure response is directly to the actuation of the switch unit 24. Thus, although in the illustrated embodiment the control elements are shown inserted and removed as by hard wiring, a plug in connection or the like, the control elements can of course be connected in circuit with appropriate switch means for operative insertion and removal. The switch units may be provided with a common actuator to prevent connection of the demand signal in circuit with another signal element.

Other periodically actuated controls may be similarly coupled to actuate the test circuit when a corresponding operation is created. Other switch means may be provided to selectively respond to a common control branch or system to produce a corresponding energization of a timer for automated testing of a multiplexity of signal indicators.

Various modes of carrying out the invention are contemplated as being within the scope of the following claims particularly pointing out and distinctly claiming the subject matter which is regarded as the invention.

I claim:

1. In a monitor apparatus including a plurality of signal lamps for indicating the status of various system operations in an operating circuit which includes a periodic functioning unit forming an operative part of at least one system operation, the improvement of a lamp failure detecting system during the operation of said operating circuit comprising energizing means to simultaneously energize said lamps, timing means connected to actuate said energizing means for a selected period, and control means connected to said operating circuit and to said timing means and including means actuated in synchronization with said functioning unit to automatically directly actuate said timing means in response to each operation of said periodic functioning unit of the operating circuit and thereby energize said lamps for said selected period.

2. The apparatus of claim 1 wherein said control means includes a solid state switch unit having a turn-on input, a timing capacitor connected to said input, a signal branch including a low value resistance and a high value resistance connected in series to said capacitor, sensor coupled to said periodic functioning unit and establishing a sensed signal, and means connecting said sensor to said low value resistance and said sensed signal is operable to turn-on said switch and increase a charge on said capacitor to turn-off said switch unit and thereby establish said selected period.

3. The apparatus of claim 2 wherein said low value resistance is a zero ohm resistor.

4. The apparatus of claim 2 having a reference signal source to generate a reference signal wherein said switch unit includes a signal comparator including a reference input connected to said reference signal source and said comparator including said turn-on input and driving said comparator on in response to said sensed signal having a selected relationship to the reference signal.

5. A circuit test system for testing a plurality of selectively actuated signal devices in a monitoring circuit for monitoring operation of various operating devices in an operating system including a demand signal input for supplying a demand signal for operating at least one of said various operating devices, each signal device providing a generally corresponding known output, said circuit test system comprising control means operable to simultaneously energize all of said signal devices, a reference voltage dividing circuit establishing a reference signal, a control voltage dividing circuit including a first resistor and a second resistor connected in series for establishing a control signal, a comparator having an output and having a first input connected to said reference voltage dividing circuit and said reference signal and having a second input connected to said control voltage dividing circuit for selectively driving said comparator on in response to said control signal having a selective relationship to the reference signal at said first input a demand signal line connecting said control voltage dividing circuit and establishing said control signal in response to said demand signal, said control means connected to said output of said comparator, and means to selectively open and close said control voltage dividing circuit to selectively connect said demand signal to said comparator.

6. The test system of claim 5 having a D.C. power supply including a positive voltage line and a common return line, a timing capacitor connected to said second input of said comparator, and wherein said control voltage dividing circuit includes said first resistor and said second resistor connected in series to said timing capacitor to provide a first connection of said control voltage dividing circuit to said comparator, said first resistor being a zero ohm resistor and connected to said zero ohm resistor to supply power to said capacitor and said first input through said zero ohm resistor and to charge said capacitor and thereby provide a timed operation of said comparator.

7. The test system of claim 6 including a diode selectively connected between the positive voltage line of said D.C. power supply and said capacitor to charge the capacitor and provide power to said comparator and thereby provide a second connection of said control voltage dividing circuit to said comparator.

8. The test system of claim 6 including a manual switch connected to said positive voltage line and to said control means to directly operate said signal devices.

* * * * *

UNITED STATES PATENT AND TRADEMARK OFFICE

CERTIFICATE OF CORRECTION

PATENT NO. : 5,063,374

DATED : November 5, 1991

INVENTOR(S) : JOHN J. DEISINGER

It is certified that error appears in the above-identified patent and that said Letters Patent is hereby corrected as shown below:

Claim 5, column 8, line 11, after "input" insert -- , --.

Signed and Sealed this

Ninth Day of March, 1993

*Attest:*

STEPHEN G. KUNIN

*Attesting Officer*

*Acting Commissioner of Patents and Trademarks*